United States Patent [19]

Stetter

[11] 4,420,129

[45] Dec. 13, 1983

[54] GUIDED MISSILE AND FUZE SYSTEM THEREFOR

[75] Inventor: Günter Stetter, Munich, Fed. Rep. of Germany

[73] Assignee: Messerschmitt-Bölkow-Blohm-Gesellschaft mit Beschränkter Haftung, Munich, Fed. Rep. of Germany

[21] Appl. No.: 670,910

[22] Filed: Mar. 25, 1976

[30] Foreign Application Priority Data

Mar. 29, 1975 [DE] Fed. Rep. of Germany ..... 2514136

[51] Int. Cl.[3] ..... F41G 7/22

[52] U.S. Cl. ..... 244/3.15

[58] Field of Search ..... 102/70.2 P, 70.2 R; 244/3.1, 3.15; 343/7 PF

[56] References Cited

U.S. PATENT DOCUMENTS 3,831,524 8/1974 Pollin ..... 102/70.2 P 3,978,797 9/1976 Harrington et al. ..... 102/70.2 P

*Primary Examiner*—Charles T. Jordan

*Attorney, Agent, or Firm*—Toren, McGeady and Stanger

[57] ABSTRACT

In a guided missile, in which an altitude-sensing control causes the missile to descend to a predetermined constant low altitude at a specified time before reaching a target ship, a timing mechanism waits for elapse of a predetermined interval from the descent and only then allows passage of a signal, indicative of the missile flying over a target from the control, to a warhead-detonating fuze.

6 Claims, 3 Drawing Figures

Fig.3
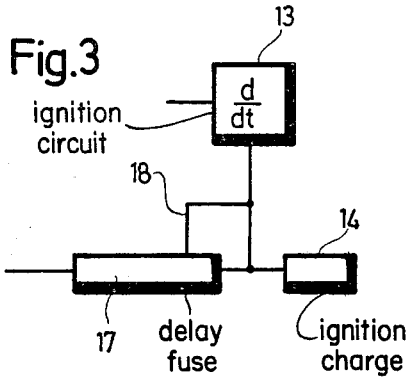
Fig.1
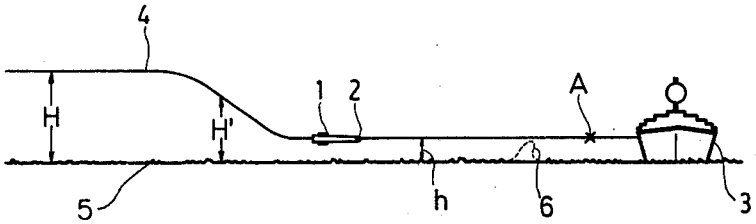
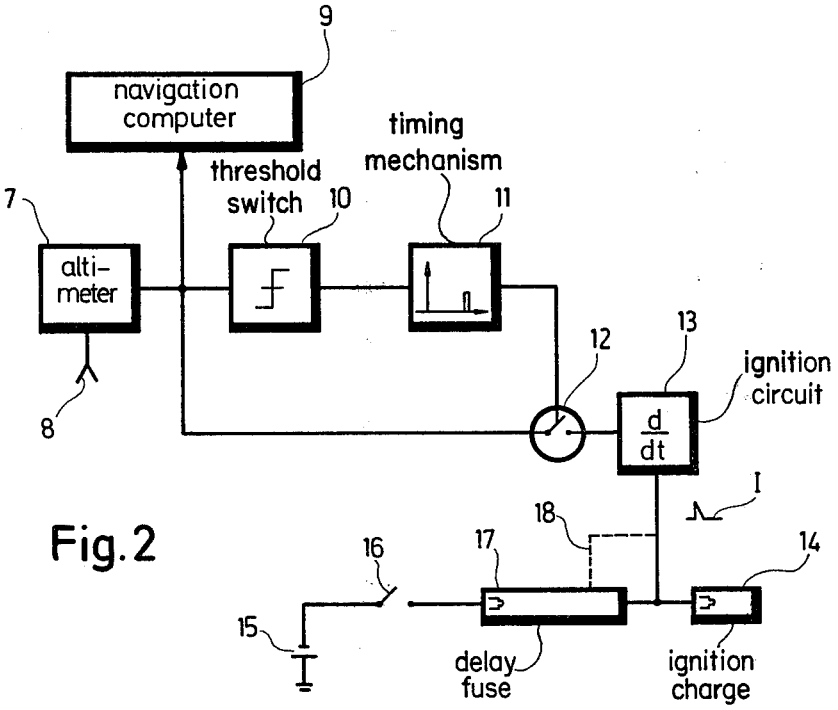
Fig.2

GUIDED MISSILE AND FUZE SYSTEM THEREFOR

BACKGROUND OF THE INVENTION

This invention relates to guided missiles and fuzes therefor, and particularly to guided missile detonating arrangements having impact fuzes, composed of a delay fuse train and igniting charge, as well as proximity-type "overflight" fuzes.

The term "fuze" as used herein denotes an electrical or mechanical mechanism used to fire a missile at or near the target. The term "fuse" denotes a pyrotechnic conduit that leads fire from one place to another.

German Pat. No. 886,252 discloses guided missiles or projectiles for use against ships' targets, in which the missile approaches the target at a constant altitude above sea level. In this disclosure the flight altitude is chosen to be sufficiently low that the target ships are generally destroyed by direct horizontal impact (referred to in the German language as "Rammtreffer"). Modern weapons technology and data electronics make it possible to obtain great strategic value from an ever increasing number of small ships and ships with low superstructures. In order to destroy such ships with low flying missiles that score direct horizontal hits (i.e. by "Rammtreffer"), the constant altitude of the low flying guided missile has to be selected to be extremely low without the projectile touching waves in the water. When the sea is rough it may not be possible to accomplish a horizontal impact strike (i.e. "Rammtreffer") upon low-aspect target ships, despite low flight altitudes.

For these reasons such missiles are provided with additional built-in "overflight" or "passing-flight" proximity fuzes. Radar is used to produce missile-target distance information. This is described in German Auslegeschrift 2009 422. However, data evaluation and subsequent derivation of a detonating signal require substantial expenditure for electronic equipment.

Moreover, proposals have been made to calculate or derive an ignition signal for the overflight fuzing during the time the missile flies over the ship, from the step-like change or variation of the output signal in the altitude measuring device which helps hold the constant low missile altitude during the target approach. While such a solution is relatively simple, there remains the possibility, slight as it may be, of the overflight fuze being detonated erroneously. This is so, because the high velocity of the missile makes it extremely difficult for the altitude measuring device to distinguish between extremely steep or high mountainous waves on the one hand and the side of the ship on the other.

An object of the invention is to improve guided missiles.

Another object of the invention is to improve guided missile fuzing systems.

Another object of the invention is to provide an arrangement capable of detonating the warhead of a guided missile either by impact or overflight, while affording such arrangement a simple structure which operates with little trouble, is reliable, and if possible, can also be added to existing guided missiles.

The invention is pointed out specifically in the claims. The following features and aspects of the invention may be considered a summary of the invention.

SUMMARY OF THE INVENTION

According to an aspect of the invention these objects are obtained in whole or part by providing a missile which approaches a target ship from a specific distance onward at a constant altitude, which altitude is determined by an altitude measuring device, with a timing mechanism that is initiated by the altitude measuring device when the projectile descends to its final target approach at which it proceeds at a constant altitude. In the missile, a switch enables or primes the overflight fuze just before the missile is supposed to reach the target. Moreover, the overflight proximity fuze has an ignition circuit which utilizes the output signal of the altitude measuring device. The ignition circuit derives an ignition pulse when the missile overlies the target.

According to another feature of the invention, the missile includes an impact fuze having a delay fuse train or delay fuse.

According to another feature of the invention the ignition circuit is connected with the delay train of the impact fuze at a point which, seen from the point of view of time, is situated closer to the detonating charge.

According to another feature of the invention all the criteria for initiating operation of the overflight fuze are derived from the output signal of the existing altitude measuring device so that additional circuits, such as distance sensing circuits are unnecessary.

These and other features of the invention are pointed out in the claims. Other objects and advantages of the invention will become evident from the following detailed description when read in light of the accompanying drawings.

BRIEF DESCRIPTION OF THE DRAWINGS

FIG. 1 is a diagrammatical representation of the approach path of a guided missile embodying features of the invention as the missile approaches a target ship during an attack.

FIG. 2 is a block diagram illustrating a fuze arrangement embodying features of the invention.

FIG. 3 is a block diagram illustrating another embodiment of a detail in FIG. 2.

DESCRIPTION OF PREFERRED EMBODIMENTS

A guided missile or projectile 1 is provided with a seeker head 2. The projectile 1 attacks a target ship 3 by traveling along a predetermined flight profile 4. At comparatively large distances from the ship 3, the projectile flies above the sea surface or sea level 5 at least at an altitude or height H from which the target ship 3 can be satisfactorily oriented or sighted by the seeker head 2. For the ultimate or final target approach, the flying projectile 1 is guided to a very low altitude or height h. The missile 1 maintains this low altitude until it strikes the target ship 3. The altitude h is chosen so that the projectile 1 does not contact waves from the sea. When the sea is rough, that is if there are high waves 6, as shown in FIG. 1 in broken lines, then the final approach altitude h must be increased. As a result it may not be possible to obtain a direct horizontal hit or strike or impact (designated in the German language as "Rammtreffer").

As shown in FIG. 2 the projectile 1 carries an altitude or height measuring device 7 with an antenna 8 whose radiation pattern is directed toward the sea surface 5. The output of the altitude measuring device 7 is connected with a navigation calculator or control 9. Both of these serve to establish and maintain the predetermined flight profile or trajectory. A threshold switch 10 also receives the output signal of the altitude measuring device and passes a start signal to a timing mechanism 11 as soon as the projectile 1 is below a predetermined height or altitude H' during transitional movement into the final target approach at the constant height h.

Due to the predetermined flight profile 4 of the projectile 1, the distance between the projectile 1 and the target ship 3, at the moment the projectile drops below the altitude H', is known. Thus, it is possible to calculate the remaining flight time until a strike or impact occurs. The timing mechanism 11 is adjusted to stop or produce a suitable signal just before the projectile reaches the target, such as a point A in FIG. 1. When the timing mechanism 11 stops or produces its signal, it closes a switch 12 which establishes the connection between the altitude measuring device 7 and an ignition circuit 13. The latter is in the form of a differentiator.

When the projectile 1 actually flies above the ship 3, then the ignition circuit 13 produces an ignition pulse I which is applied directly to an ignition charge 14 of a warhead. The warhead is not shown specifically in FIG. 2 but is part of the projectile in FIG. 1. The time constant of the ignition circuit is chosen so that the warhead explodes when the projectile is directly above the ship. This produces the greatest possible destructive effect. The ignition circuit 13 may include an additional timing circuit to establish just when the warhead explodes.

The above describes the operation when the projectile is traveling too high to strike the target ship so that an explosion in the closest proximity to the ship is produced.

By contrast, when a horizontal hit or collision with the target (Rammtreffer) is intended or possible, an impact ignitor, represented symbolically by a voltage source 15, an impact contact 16, and a pyrotechnic delay chain or fuse 17, is actuated. The delay time of the pyrotechnic fuse 17 is chosen so that the warhead is not ignited until the projectile has moved along a path into the ship. The ignition charge 14 ignites the warhead. This also produces a substantial destructive effect.

It is of course possible that the output of the ignition circuit 13 also actuates the pyrotechnic delay fuse. This can be accomplished by connecting the members 13, 14, and 17 with the line 18 as shown in FIG. 3. In this embodiment of the invention, the time behavior of the overflight ignitor is adapted so that the warhead is ignited when the projectile is situated directly above the ship 3.

An ignition system in accordance with the invention is simply constructed. It is suitable for subsequent addition or modification of existing projectiles or missiles because nothing in the existing complicated electronic circuitry needed for navigation of the projectile, such as the seeker head, need be changed.

Because the time between the start of the movement (or impact orientation) of the projectile into the final target approach, which approach occurs at a constant altitude, up to the strike is known, and thus the operating time of the timing mechanism can be adjusted so as to prime the overflight fuze or overflight ignitor just prior to the strike or just prior to the overflight, accidental release during the remaining short path to the target due to wave clutter or enemy jamming measures is improbable.

The overflight fuze, preferably applies the detonating signal directly to the detonating charge which is also used by the impact fuze. This is so because generally the ignition circuit, particularly the altitude measuring device, has a small time constant. The high velocity of the missiles makes it undesirable to add any further delay when the warhead of the projectile is to explode while still above the target ship.

The invention makes it possible for the missile to explode within the target ship when a direct horizontal hit ("Rammtreffer") occurs because of the delay train or fuze train of the impact fuze. The overflight fuze also produces the largest destructive effect because the warhead is detonated with a lesser delay and directly above the target ship.

It should be noted that the ignition circuit 13 differentiates the output of the measuring device 7. Thus any significant change in the sea contour, such as a ship, produces a variation in the output of the device 7. This variation is differentiated by the circuit 13.

While embodiments of the invention have been described in detail, it will be obvious to those skilled in the art that the invention may be embodied otherwise without departing from its spirit and scope.

Flight controls such as control 9 are well known. One such control is disclosed in the publication GUIDANCE, Arthur S. Locke, D. van Nostrand Company, Inc., Princeton, 1955, page 543–545. An altitude measuring device such as 7 is disclosed in said Locke, page 382.

I claim:

1. For a guided missile having an impact fuze with a delay arrangement and an ignition charge and having an altitude measuring device as part of a trajectory control which measures the altitude and guides the missile toward a target from a first altitude through a lower transitional altitude and into a constant altitude as it approaches a target ship, an auxiliary fuze arrangement comprising a timing device, an enabling switch, an ignition circuit, said timing device being coupled to said altitude measuring device and responding to the missile reaching the transitional altitude and being coupled to the enabling switch for enabling the switch a predetermined time after the transitional altitude is reached, said ignition circuit being connected to one of said delay arrangement and said ignition charge for initiating ignition of the ignition charge, said enabling switch connecting the altitude measuring device to said ignition circuit when the enabling switch is enabled so that said ignition circuit responds to altitude measurements indicative of a target ship.

2. An arrangement as in claim 1, wherein said ignition circuit is connected with said ignition charge.

3. An arrangement as in claim 1, wherein said ignition circuit is connected with the delay arrangement.

4. A guided missile comprising an impact fuze, said impact fuze having a delay arrangement and an ignition charge, guidance means having an altitude measuring device producing signals which vary with the altitude of the missile while it is flying; said guidance means further including control means responsive to said altitude measuring device for seeking a target at one altitude, guiding the missile through a transitional altitude to a constant approach altitude which the missile assumes as it approaches the target, auxiliary fuze means coupled to the altitude measuring device and the impact fuze for igniting the ignition charge when the altitude measuring device indicates an abrupt change, and a time switch coupled between the altitude measuring device and the auxiliary fuze and responsive to the altitude measuring device indicating that the missile has reached the transitional altitude and enabling the auxiliary fuze only a predetermined time after the missile has reached the transitional altitude.

5. A missile as in claim 4, wherein said auxiliary fuze is coupled directly to the ignition charge of said impact fuze for igniting the charge.

6. A missile as in claim 5, wherein said auxiliary fuze is connected to the delay arrangement for producing a delay from the time of operation of the auxiliary fuze to ignition of the ignition charge.

* * * * *